United States Patent [19]

Di Nunzio

[11] 4,092,717

[45] May 30, 1978

[54] METHOD AND APPARATUS FOR STABILIZING THE THROUGH FLOW OF ELECTROMAGNETIC INJECTORS

[75] Inventor: Vittorio Di Nunzio, Turin, Italy

[73] Assignee: FIAT Societa per Azioni, Turin, Italy

[21] Appl. No.: 736,684

[22] Filed: Oct. 28, 1976

[30] Foreign Application Priority Data

Nov. 12, 1975 Italy ..... 69788 A/75

[51] Int. Cl.[2] ..... F02B 3/00

[52] U.S. Cl. ..... 364/431; 123/32 EF; 361/198; 364/569

[58] Field of Search ..... 235/150.2, 150.21; 123/32 EA, 32 AE, 32 EF; 364/424, 431, 442

[56] References Cited

U.S. PATENT DOCUMENTS

| | | | |
|---|---|---|---|
| 3,744,460 | 7/1973 | Monpetit | 123/32 EA |
| 3,834,362 | 10/1974 | Takeshita et al. | 123/32 EA |
| 3,854,458 | 12/1974 | Reddy | 123/32 EA |
| 3,982,505 | 9/1976 | Rivere | 123/32 EA |
| 3,987,764 | 10/1976 | Scofield | 123/32 EA |
| 4,015,563 | 4/1977 | Drews et al. | 123/32 EA |

*Primary Examiner*—Felix D. Gruber
*Attorney, Agent, or Firm*—Sughrue, Rothwell, Mion, Zinn and Macpeak

[57] ABSTRACT

In order to stabilize the open time of an electromagnetic fuel injector against variation of vehicle battery voltage, first and second threshold values of solenoid current for opening and closing of the injector are predetermined experimentally, the duration of the injection control signal being determined from the time the first current threshold is reached. The battery voltage dependent delay between the end of the injection control signal and the reaching of the second current threshold as the solenoid current decays is subtracted from the duration of the injector opening control signal for the subsequent injection cycle.

6 Claims, 12 Drawing Figures i
t i
A
B
t

V
τ
δ
t $x_i$
τ×i
t i
t

V
t i
A
B
τ
t

Xi
τ × i
t

N
δ
t

Q7
t

METHOD AND APPARATUS FOR STABILIZING THE THROUGH FLOW OF ELECTROMAGNETIC INJECTORS

The present invention relates to a process for the stabilization of the through flow, that is, the open time, of electromagnetic injectors in a fuel injection system, particularly for motor vehicle engines, such that the amount of fuel injected for a given injector open time is independent of the vehicle battery voltage. The invention also relates to a device for carrying out the said process.

It is known that in a fuel injection system of the aforementioned type having solenoid-operated injectors the opening movement of each injector piston commences only when the solenoid energizing current has reached a well-defined value, that is to say, when the force applied to the piston by the operating solenoid equals the sum of the forces which oppose the piston movement, these latter forces comprising the preloading of a spring acting on the piston and a force due to the pressure existing within the injector itself. A certain delay is, moreover, inevitable in the subsequent closure of the injector because of magnetic hysteresis pheonomena, resulting in a delay in the suppression of the magnetic flux of the operating solenoid with respect to the energizing current. Consequently, for every type of electromagnetic fuel injector of given constructional characteristics it is possible to produce a current/time characteristic for the operating solenoid, of the type shown diagrammatically in FIG. 1 of the accompanying drawings.

It is also known that the operating solenoid controlling the opening of an electromagnetic injector is equivalent, from the electrical point of view, to an inductance and a resistance in series, so that the energizing current in the solenoid rises exponentially, the magnitude of the current being proportinal to the supply voltage, that is, to the vehicle battery voltage. As the magnitude of the peak energizing current increases, the current decay time increases so that for given duration of energizing current, the injector open time and, therefore, the amount of injected fuel, is dependent on battery voltage.

The object of the present invention is to provide a process for stabilization of the open time of electromagnetic injectors in a fuel injection system, and a device for carrying out this process, which avoids the aforementioned disadvantages and which is of simple construction and low cost.

According to the present invention there is provided a process for the stabilization of the open time of an electromagnetic injector in a fuel injection system, particularly for motor vehicles, such that the amount of fuel injected for a given injector open time is independent of a supply or battery voltage, wherein first and second threshold values of energizing current for an injector operating solenoid are predetermined experimentally to determine the instants at which a fuel injector opens and closes in each cycle, characterised in that the computation of the duration of both an injection control signal, which determines the period of opening of the injection, and the time of start of the injection commences from the moment the current in the operating solenoid reaches the first current threshold and in that the delay time between the end of the injection control signal and the moment when the current in the operating solenoid falls to the second threshold in an injection cycle is subtracted from the effective open time of the injector to obtain the desired time of duration of the injector opening control signal for successive injection cycles.

By means of the process of the present invention account can be taken of the current rise time of the injector operating solenoid when energized and of the decay time of the solenoid flux when de-energized to compute a corrected injector opening control signal.

The invention also provides a device for carrying out the aforesaid process characterized in that it comprises first means producing a signal having a period proportional to the desired duration of the injection period, the output of said first means being connected to a first input of a coincidence circuit a second input of which is provided by the output of a two-threshold comparator circuit, the output of the coincidence circuit being connected to the first input of a counter a second input of which is constituted by a reset signal produced by a differentiating network supplying a commutation signal to a commutator circuit the output of which is connected through a switching circuit to the said two-threshold comparator circuit. The duration of the injection pulse is dependent primarily on the time it takes for the counter to reach a predetermined value, but is also dependent on the lag time between the termination of the injector solenoid control signal and the time at which the solenoid actually turns off. This lag time is dependent on the current level through the injector solenoid at the end of the injection signal which, in turn, is dependent on the battery voltage supplied to the solenoid. The above-described circuit permits the counter to begin counting during the lag time so that this lag time will effectively be subtracted from the duration of the next injection signal, thereby maintaining an injection control signal which is substantially independent of battery voltage.

The invention will be further described, by way of non-limiting example, with reference to the accompanying drawings, in which.

Figures 1, 2, 3, 4:
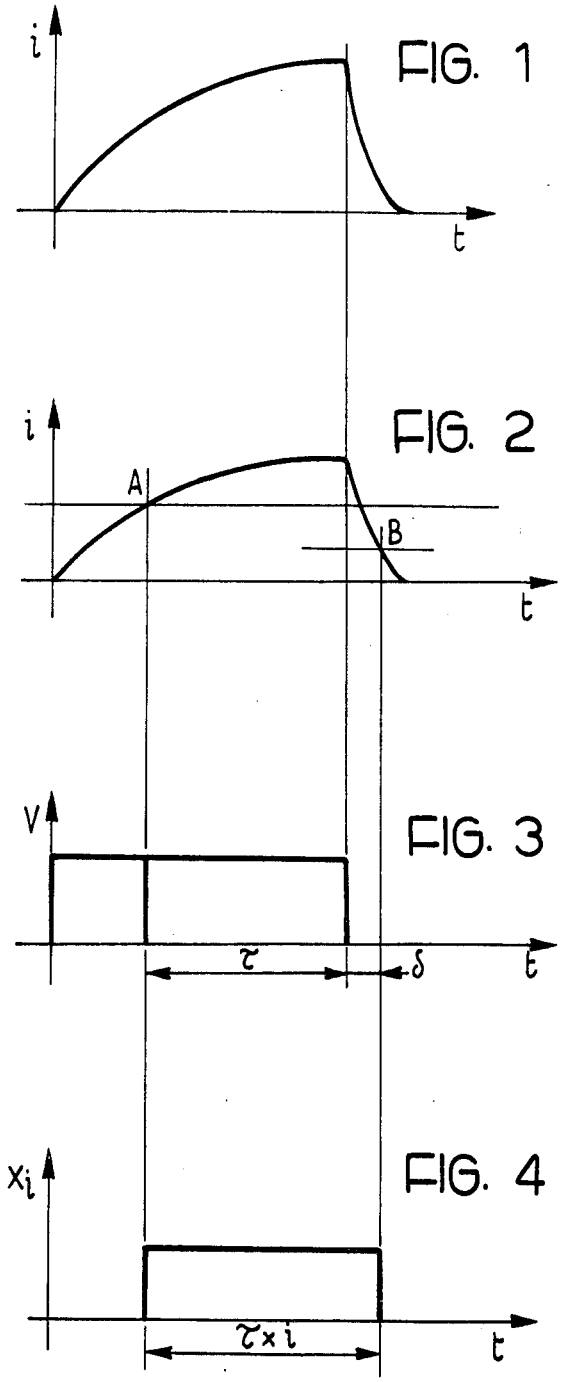
FIG. 1 represents the variation with time $t$ of the current $i$ in the operating solenoid of an electromagnetic fuel injector.
FIG. 2 is a curve representing the variation of the current $i$ in an injector operating solenoid as a function of time $t$, showing predetermined thresholds which intersect the curve and which determine the start and finish of fuel injection.
FIG. 3 represents graphically the variation in time $t$ of the injector control voltage which controls the opening and the closing of a fuel injector.
FIG. 4 represents the effective duration of the fuel injection period with the same time scale $t$ as that of FIG. 2.
Figure 6:
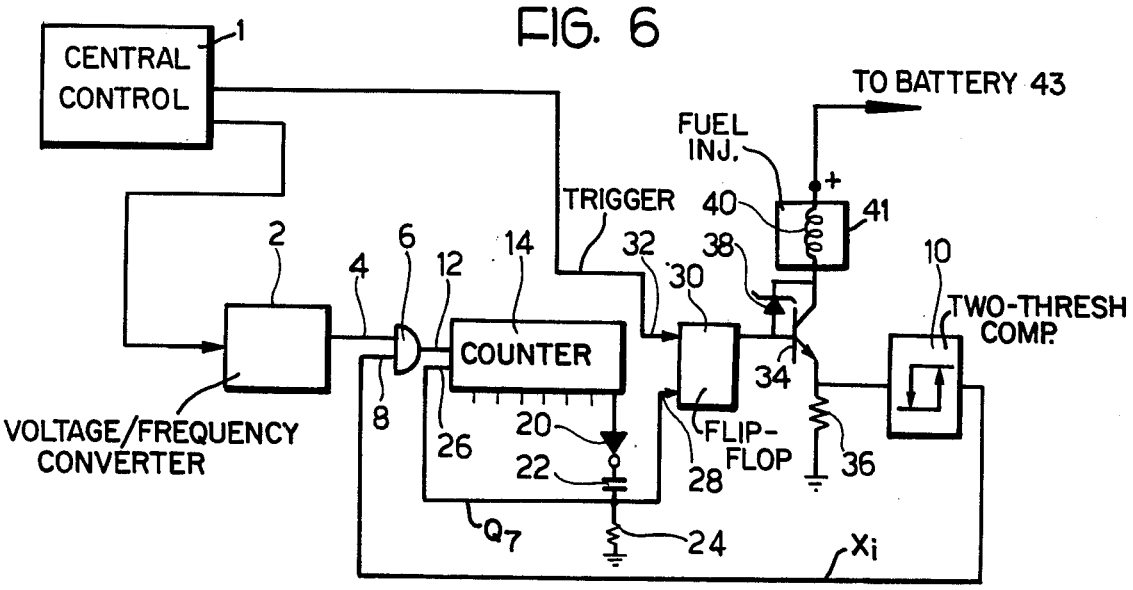
FIG. 6 is a diagrammatic representation of a device for carrying out the process according to the invention.

Referring first to FIG. 6, control voltage V from a central control unit 1 is supplied to a voltage-frequency converter 2 which provides control pulses forming one input 4 of a coincidence circuit (AND gate) 6 the other input 8 of which is provided by the output of a two-threshold comparator circuit 10. The repetition frequency of the pulses from the converter 2 is dependent upon the voltage applied thereto, which, in turn, is dependent on operating parameters of the engine, e.g., pressure, temperature and engine speed.

The output of the AND gate 6 is passed to a clock input 12 of a pulse counter 14; the output of the counter 14 is connected through an inverter 20 to a differentiating network formed by a capacitor 22 and a resistor 24 connected to ground.

The output of the differentiating network is taken from the junction of the capacitor 22 and resistor 24 and is passed to a reset input 26 of the said counter 14 and to a first input 28 of a flip-flop circuit 30. The flip-flop circuit 30 has a second input 32 to which a trigger signal is applied from the central control unit 1. The output of the flip-flop circuit 30 is applied to the base of a transistor 34, the emitter of which is an injector control voltage connected to the input of the comparator circuit 10 and to one end of a resistor 36 the other end of which is connected to ground.

Between the base and the collector of the transistor 34 a Zener diode 38 is inserted to protect the transistor 34 against over-voltages upon closure of the associated injector nozzle. The collector of the transistor 34 is connected to one end of an operating solenoid 40 of a fuel injector 41, the other end of the solenoid 40 being connected to a positive voltage source, e.g., the vehicle battery 43. When energized the solenoid 40 moves an obturator piston of the associated injector 41 against the action of a biasing spring, causing the injector to open.

Figures 7, 8, 9, 10, 11, 12:
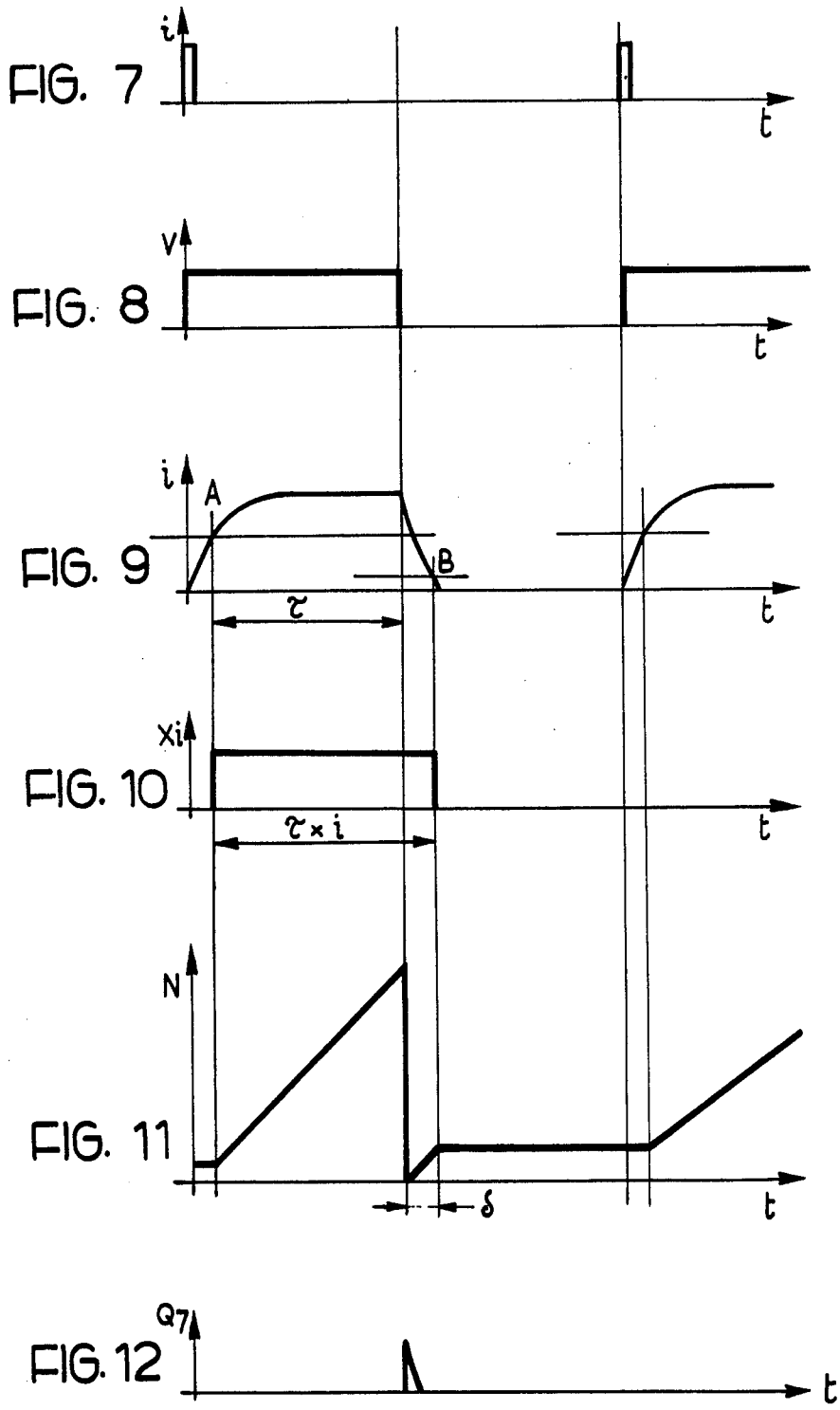
FIGS. 7 to 12 represent diagrammatically the variation with time $t$ of various parameters associated with the operation of the device shown in FIG. 6.

FIGS. 7 to 12 represent respectively the variation with time $t$ of: the current pulses $i$ initiating the start of each injection cycle (FIG. 7); the injector control voltage signal which is supplied by the output of flip-flop 30 and determines the open time of injector 41 (FIG. 8); the injector solenoid energizing current $i$ (FIG. 9), the output signal Xi from comparator 10 in the circuit of FIG. 6 (FIG. 10); the progressive count of the counter 14 (FIG. 11), and the output signal $Q_7$ from the counter 14 (FIG. 12).

In the process according to the invention, in order to ensure that the control signal controlling the open time of the injector has the necessary duration to ensure the desired effective period of opening of the injector, it is necessary to predetermine the exact instants when the injector effectively opens and closes. These instants can be derived experimentally in the following manner.

A first current threshold A is established such that once this threshold is exceeded by the current in the injector solenoid the injector opens. A second current threshold B is also determined such that when the injector solenoid current falls below this threshold the injector closes.

Figure 5:
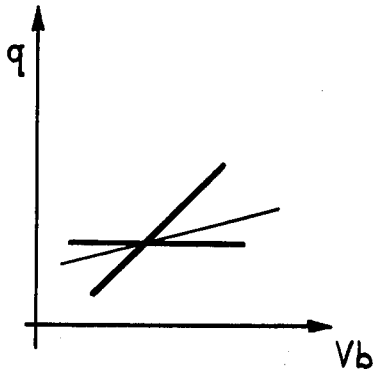
FIG. 5 represents diagrammatically the variation of the flow of fuel $q$ through an injector as a function of the battery voltage $Vb$ of a vehicle for three different valves of the thresholds determining the start and finish of injection.

Assume the effective duration of the injection period, that is, the actual open time of the injector, is the time elapsing between the intersection of the said thresholds A and B with the curve of variation of the energizing current of the operating solenoid of the injector (FIG. 9). Measurements are then made of the injector through-flow as a function of the battery voltage, obtaining a curve such as that of FIG. 5. By varying the aforementioned thresholds A and B and making further such injector through-flow measurements in the manner indicated above it is possible to establish experimentally a condition in which the injector through-flow is constant, that is to say, the period of injector opening is independent of variation of the battery voltage.

It is possible to check that the precise moments of opening and closing of the injector have been predetermined accurately, on the assumption that the movement of the injector piston is instantaneous, which is for practical purposes the case for electromagnetic injectors of the ON-OFF type used for this type of application.

Referring to FIGS. 7 to 12 it will be seen that upon energization of the injector solenoid the injector starts injecting fuel only when the slenoid current reaches the first threshold A, the injection ceasing when the solenoid current falls below the threshold B.

There is a certain delay $\delta$ between the end of the solenoid energizing control signal (FIG. 8), coinciding with the instant of peak solenoid current in FIG. 9, and the effective closing of the injector, at threshold B, due to the decay of flux in the solenoid after de-energization thereof. This delay $\delta$ varies upon variation of the battery voltage, which in turn varies slightly with variation of the injection frequency. It can therefore be assumed that $\delta$ varies but little in response to variation of injection frequency. Energization of the injector solenoid commences at the time zero in response to signal pulses (FIG. 7) from the central control unit.

The computation of the duration of the injection period starts only when the value of the solenoid energizing current $i$ reaches the threshold A, predetermined in the manner mentioned hereabove. At this moment the injector opens, and when the command signal (FIG. 8) from the flip-flop 30 determines the time of de-energization of the solenoid the injector will still remain open for a further time $\delta$.

The injector control signal from the central control unit continues for a duration $\tau$ measured from the start of effective injection, and the actual time that the injector is open is represented by $\tau_{Xi}$. Clearly $\tau\ \tau_{xi} - \delta$.

It will be clear that the injection cycle under examination cannot be modified but the predetermined value of the delay $\delta$ can be used to correct the total open time of the succeeding injection cycles. It follows that once the opening and closing thresholds A and B have been precisely established it is possible to correct the delay preceding the actual opening and closing of the injector and thereby correct the actual period of opening of the injector. The present invention provides a process for correcting the injector opening control signal by means of the time delay $\delta$.

The operation of the device which carries out the process according to the invention will now be described with reference to FIGS. 6 to 12. The control signals (FIGS. 7 and 8) for determining the duration of the fuel injection pulses are provided by the central control unit 1 and flip-flop circuit 30, respectively. The duration of the injection control signals (FIG. 8) is dependent on the time required for the counter 14 to reach a predetermined value. This time depends on the frequency of pulses from converter 2 which, in turn, depends on the control voltage V supplied to the converter 2 from the central control unit 1. Since the control voltage V is dependent on engine operating parameters such as pressure, temperature and engine speed, it follows that the duration of the injection control signal is determined by these engine operating parameters.

The two-threshold comparator 10 has a first, upper, threshold A for switching on to logic level 1 and a second, lower, threshold B for switching back from logic level 1 to logic level 0.

The central control unit also provides trigger pulses (FIG. 7) which determine the start of each injection cycle and which are supplied to the second input 32 of the commutation circuit 30, which comprises a bistable multivibrator, the output of which (shown in FIG. 8) is brought to logic level 1 and causes the switching circuit (transistor) 34 to start conducting. The current *i* in the solenoid 40 connected to the collector of the transistor 34 increases exponentially as shown in FIG. 9, and when it reaches the first threshold A the two-threshold comparator 10 changes its output from logic level 0 to logic level 1; this output is passed to the input 8 of the AND gate 6, enabling the latter to pass the output signal from the converter 2. This enables the counter 14 to commence counting of the signals provided by the converter 2, continuing counting until full. The counter 14 in the illustrated example is a 7 bit one having a capacity of $(2^7 - 1)$, that is, 127.

When the counter 14 is full, the signal of the most significant bit, that is to say, that of the highest order, is inverted by the inverter 20 and differentiated by the differentiating network formed by capacitor 22 and the resistor 24, giving rise to the pulse signal $Q_7$ represented in FIG. 12 which is applied to the counter 14 to reset it to zero. In effect, the counter 14 will have already been set to zero by the next succeeding input signal following the filling of the counter; the resetting of the counter by the pulse $Q_7$ is an additional safety measure. The pulse signal $Q_7$ from the differentiating network also applied to the second input 28 of the bistable multivibrator constituting the flip-flop circuit 30, causing the latter to commutate from the logic state 1 to the logic state 0, and thereby cutting off the transistor 34. From this moment, because of the inductance of the solenoid 40, the current in the solenoid decays exponentially.

In the meantime, because the output of the comparator 10 remains at logic level 1, the comparator continues to provide the signal X*i* and the AND gate 6 remains open, so that the counter 14 again starts to count, for as long as the solenoid current remains above the second threshold B (FIG. 9). When the solenoid current falls to the threshold B the two-threshold comparator 10 commutates from the logic level 1 to the logic level 0, closing the AND gate 6 which then ceases to pass the pulses from the converter 2 to the counter 14, which thereupon ceases to count, stopping with a stored number representing the desired delay period $\delta$.

In the next succeeding cycle the counter 14 starts from this stored numerical value (FIG. 11) and therefore the time $\tau$ it takes to fill will be shortened to 128T $- \delta$, that is, using the notations used in FIGS. 9, 10, 11, $\tau = \tau_{xi} - \delta$. This time $\tau$, representing the duration of the count in the counter 14 and therefore the duration of the injector opening control signal will be such as to give exactly the required effective open time $\tau_{xi}$ of the injector. In fact the signal X*i* (FIG. 10) representing the actual open time of the injector allows the exclusion of the rise phase of the solenoid current during which the injector does not open, and also allows account to be taken of the delay $\delta$ between removal of the solenoid energizing signal and the actual closure of the injector. Since these rise and decay times are dependent on the battery voltage applied to the injector solenoid, eliminating them from the effective injection signal results in an injection signal having a duration substantially independent of battery voltage.

I claim:

1. In a fuel injection system of the type wherein an injector control pulse defines the time during which energizing current is supplied to the operating solenoid of an electromagnetic fuel injector from a vehicle battery, said injector opening when the level of said solenoid energizing current exceeds a first predetermined threshold value A and closing when said solenoid energizing current falls below a second predetermined threshold value B, thereby defining an injector open period of duration $\tau_{xi}$, a device for stabilizing the open period of said injector so that said open period $\tau_{xi}$ is of a desired duration substantially independent of battery voltage, comprising:

first means producing a signal having a period proportional to the desired duration of the injection period, a coincidence circuit having a first input connected to the output of said first means and a second input, a two-threshold comparator circuit the output of which is connected to the second input of the coincidence circuit, a counter having a first input connected to the output of the said coincidence circuit and a second input, a differentiating network providing a reset signal at said second input, a flip-flop circuit having an input constituted by the output of the differentiating network, and a switching circuit, controlled by the output from said flip-flop circuit, for providing to said comparator a voltage signal proportional to the energizing current through said operating solenoid.

2. The device defined in claim 1 wherein the said coincidence circuit comprises an AND gate.

3. The device defined in claim 1 wherein the switching circuit comprises a transistor the emitter of which is connected to the input of the comparator circuit.

4. The device defined in claim 3, wherein the collector of the transistor is connected to the operating solenoid of the associated fuel injector.

5. The device defined in claim 1, wherein the said first means comprise a voltage-frequency converter which generates signals with a repetition period determined by an applied voltage which is in turn proportional to the desired duration of the injection period.

6. In a fuel injection system of the type wherein an injector control pulse defines the time during which energizing current is supplied to the operating solenoid of an electromagnetic fuel injector from a vehicle battery, said injector opening when the level of said solenoid energizing current exceeds a first predetermined threshold value A and closing when said solenoid energizing current falls below a second predetermined threshold value B, thereby defining an injector open period of duration $\tau_{xi}$, a method of stabilizing the open period of said injector so that said open period $\tau_{xi}$ is of a desired duration substantially independent of battery voltage, comprising:

providing an injection control pulse, the duration of which is controlled by a duration control means;

generating a signal corresponding to the battery voltage dependent decay time $\delta$ between the end of said injection control pulse and the time at which the solenoid energizing current falls below said second threshold value B;

offsetting said duration control means by said signal so that the duration of the next injection control pulse is shortened by an amount equal to said decay time $\delta$, thereby obtaining an injector open period of a desired duration $\tau_{xi}$.

* * * * *